US007761030B2

(12) United States Patent
Ahn et al.

(10) Patent No.: US 7,761,030 B2
(45) Date of Patent: Jul. 20, 2010

(54) DEVELOPING UNIT HAVING FOLDABLE HANDLE AND IMAGE FORMING APPARATUS HAVING THE SAME

(75) Inventors: Byung-Sun Ahn, Suwon-si (KR); Joo-Hwan Noh, Yongin-si (KR); Yong-Kon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/905,329

(22) Filed: Sep. 28, 2007

(65) Prior Publication Data

US 2008/0025756 A1 Jan. 31, 2008

Related U.S. Application Data

(63) Continuation of application No. 11/166,251, filed on Jun. 27, 2005, now Pat. No. 7,292,803.

(30) Foreign Application Priority Data

Aug. 28, 2004 (KR) ..... 2004-68269

(51) Int. Cl.
*G03G 15/00* (2006.01)
*G03G 21/16* (2006.01)

(52) U.S. Cl. ..... 399/107; 399/110; 399/111

(58) Field of Classification Search ..... 399/112, 399/114, 107, 110, 111
See application file for complete search history.

(56) References Cited

U.S. PATENT DOCUMENTS

| | | | | |
|---|---|---|---|---|
| 5,784,671 | A | 7/1998 | Damji | |
| 7,123,873 | B2 | 10/2006 | deJong et al. | |
| 7,424,243 | B2 * | 9/2008 | Kweon | 399/107 |
| 2004/0037587 | A1 * | 2/2004 | Yamaguchi et al. | 399/119 |
| 2004/0165910 | A1 * | 8/2004 | Sato et al. | 399/116 |

FOREIGN PATENT DOCUMENTS

| | | | |
|---|---|---|---|
| JP | 61-230159 | | 10/1986 |
| JP | 63193161 | | 8/1988 |
| JP | 05011603 | A * | 1/1993 |
| JP | 10-282863 | | 10/1998 |
| JP | 2000-147980 | | 5/2000 |
| JP | 2001-042622 | | 2/2001 |
| JP | 2002-328586 | | 11/2002 |
| JP | 2003-195730 | | 7/2003 |
| KR | 1992-0004922 | | 3/1992 |

* cited by examiner

*Primary Examiner*—David M Gray
*Assistant Examiner*—Joseph S Wong
(74) *Attorney, Agent, or Firm*—Roylance, Abrams, Berdo & Goodman, L.L.P.

(57) ABSTRACT

An image forming apparatus is provided having a developing unit including a handle. The developing unit of the image forming apparatus includes at least one of a photosensitive body and a developing roller developing a developer on the photosensitive body. A case protects the image forming unit and a handle is installed on the case to handle the developing unit. The handle is rotated by a hinge which pivots, in close proximity to the case, between a first position to protect the case from external impact and a second position opposite to the first position, and which is installed in an approximate center of the case when viewed from a side direction.

10 Claims, 5 Drawing Sheets

DEVELOPING UNIT HAVING FOLDABLE HANDLE AND IMAGE FORMING APPARATUS HAVING THE SAME

CROSS-REFERENCE TO RELATED APPLICATIONS

This application is a continuation of prior U.S. patent application Ser. No. 11/166,251, filed Jun. 27, 2005 now U.S. Pat. No. 7,292,803, and claims the benefit under 35 U.S.C. §119 (a) of Korean Patent Application No. 2004-68269, filed on Aug. 28, 2004, the entire disclosures of each of which are hereby incorporated by reference.

BACKGROUND OF THE INVENTION

1. Field of the Invention

The present invention generally relates to a developing unit of an image forming apparatus. More particularly, the present invention relates to an image forming apparatus having a developing unit with a foldable handle.

2. Description of the Related Art

As shown in FIG. 1, a general image forming apparatus 1 includes a paper cassette 10, a transport unit 20, a developing unit 30, a transfer unit 40, a fixing unit 50, and a paper discharging unit 60.

The paper cassette unit 10 stores a plurality of sheets of paper. The transport unit 20 transports the sheets of paper stored in the paper cassette unit 10 to the developing unit 30. The paper cassette unit 10 includes a pickup roller 11. The transport unit 20 includes a plurality of pairs of transport rollers 21 and 22.

The developing unit 30 includes a photosensitive body 32 to receive light from an exposing unit 31 to form an electrostatic latent image, and a developing case 34 pivotably supporting the photosensitive body 32. The developing case 34 includes a developer container 33 containing a developer for developing the electrostatic latent image formed on the photosensitive body 32.

The transfer unit 40 transfers a visible image formed on the photosensitive body 32 to a sheet of paper.

The fixing unit 50 passes the sheet of paper to which the visible image has been transferred to apply heat and pressure to the sheet of paper. Thus, the visible image is fused and fixed onto the sheet of paper.

The paper discharging unit 60 discharges the sheet of paper which has passed through the fixing unit 50.

The developing unit 30 preferably is replaced when the developer contained in the developer container 33 is exhausted. For this purpose, the general image forming apparatus includes a cover 2 that can be opened and closed. The developing unit 30 includes a handle 35 for easily handling the developing unit 30. In general, the handle 35 is pivotably hinged on the developing case 34 and is preferably fixed on the developing case 34.

However, in the above-described developing unit 30 of the general image forming apparatus, the handle 35 protrudes farther than an outer periphery of the developing case 34. Thus, when the developing unit 30 is packaged, the size of the developing unit 30 increases. Also, the handle 35 is limitedly used to remove the developing unit 30. Thus, the handle 35 is non-economical in terms of its utility value compared to its size.

Accordingly, there is a need for an image forming apparatus having a developing unit with a foldable multipurpose handle that does not protrude substantially beyond the periphery of the developing unit when being folded so as to reduce the size of the developing unit and which may also be used as a paper guide.

SUMMARY OF THE INVENTION

An aspect of the present invention is to solve at least the above problems and/or disadvantages and to provide at least the advantages described below. Accordingly, an aspect of the present invention is to provide a developing unit having a foldable multipurpose handle which does not protrude substantially beyond the periphery of the developing unit when being folded so as to reduce the size of the developing unit. Moreover, the foldable multi-purpose handle is also used as a paper guide as well as a handle when being unfolded.

According to an aspect of the present invention, there is provided a developing unit of an image forming apparatus including an image forming unit including at least one of a photosensitive body. A developing roller for developing a developer on the photosensitive body. A case to protect the image forming unit and a handle installed at the case to handle the developing unit. Accordingly, the handle is rotated by a hinge which pivots, in close proximity to the case, between a first position to protect the case from external impact and a second position opposite to the first position, and which is installed in an approximate center of the case when viewed from a side direction.

Preferably, the first position is a storage position, and the second position is a use position.

It is also preferable that the handle has a substantially smaller width than a width of the case. Moreover, it is preferably that the handle is installed at an approximate center of the case to be folded by a hinge.

The handle preferably includes a guide plate, and a gripping unit protruded from an end portion of the handle. A plurality of guide ribs may be formed on a surface of the handle. It is also preferable that the handle may be protruded from a portion connected with hinge, and may have a bent portion. It is also preferable that the handle may include two connection portions connected with the hinge.

According to another aspect of the present invention, there is provided an image forming apparatus including a body frame with a developing unit mounting unit. A paper feeding unit is disposed on the body frame and comprises a plurality of sheets of paper. An auxiliary paper feeding unit is installed on the body frame to feed sheets of paper having various sizes and includes a paper path partially overlapping with a paper path of the paper feeding unit. A transfer unit is provided for transferring a sheet of paper picked up by the paper feeding unit or the auxiliary paper feeding unit and a developing unit is attachable to or detachable from the developing unit mounting unit of the body frame. The developing unit preferably includes an image forming unit with at least one of a photosensitive body and a developing roller for developing a developer on the photosensitive body. It is also preferable to provide a case to protect the image forming unit. It is also preferable to provided a handle rotated by a hinge which is foldably installed on the case to attach and detach the developing unit, and which is installed in an approximate center of the case when viewed from a side direction.

The handle preferably pivots to a first position attached to the case and a second position opposite to the first position. The first position is preferably a storage position, and the second position is preferably a use position.

It is also that the handle has a substantially smaller width than a width of the case and is installed in an approximate center of the case and is installed in a location such that a force by which the handle is pulled is directed toward a center of the developing unit.

The handle preferably includes a guide plate, and a gripping unit protruded from an end of the handle. A plurality of guide ribs may be formed on a surface of the guide plate.

The auxiliary paper feeding unit may also be installed between the developing unit and the paper feeding unit. It is also preferably to provided a case to protect the image forming unit. It is also preferable to provided a handle installed on the case to handle the developing unit. According to another aspect of the present invention, there is provided a handle for developing unit rotated by a hinge which is foldably installed on a case of a developing unit provided attachably or detachably in an image forming apparatus, and which is installed in an approximate center of the case when viewed from a side direction.

It is preferable that the first position may be a storage position, and the second position may be a used position. It is also preferable that the handle has a substantially smaller width than a width of the case and is installed in an approximate center of the case to be folded by a hinge.

The handle preferably includes a guide plate, and a gripping unit substantially protruded from an end portion of the handle. A plurality of ribs may be formed on a surface of the handle.

It is also preferable that the handle is protruded from a portion connected with the hinge and has a bent portion.

The handle for developing unit preferably includes two connection portions connected with the hinge.

Accordingly, the handle may be foldably installed on the developing unit. Thus, when the developing unit is packaged, the size of the developing unit may be reduced. Also, an external impact on the developing unit may be relieved. As a result, the durability of the developing unit is improved. In addition, the handle can be used to mount and remove the developing unit. Moreover, when the handle is installed on the developing unit, the handle is unfolded for use as a paper guide as well as a handle. Accordingly, the utility value of the handle is improved.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
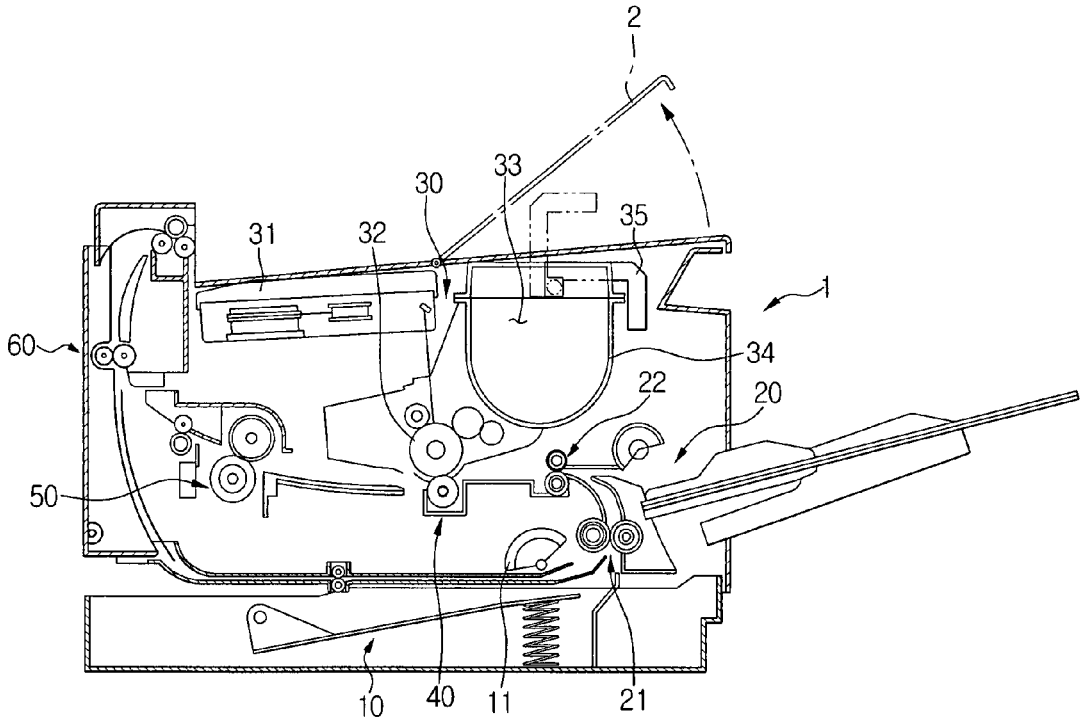
FIG. 1 (PRIOR ART)
FIG. 1 illustrates a general developing unit and an image forming apparatus including the general developing unit.
Figure 2:
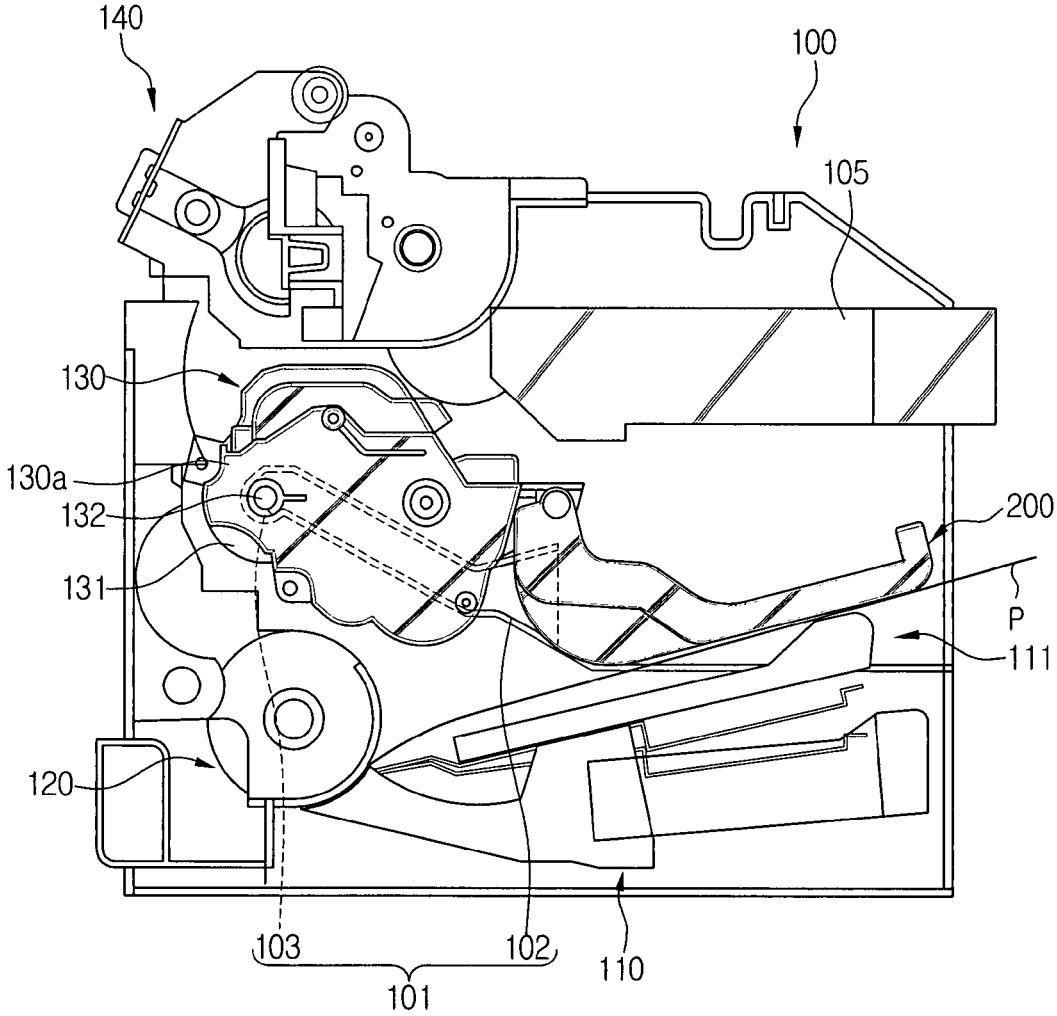
FIG. 2 illustrates a developing unit including a foldable handle and an image forming apparatus including the developing unit in accordance with an embodiment of the present invention.
Figure 3:
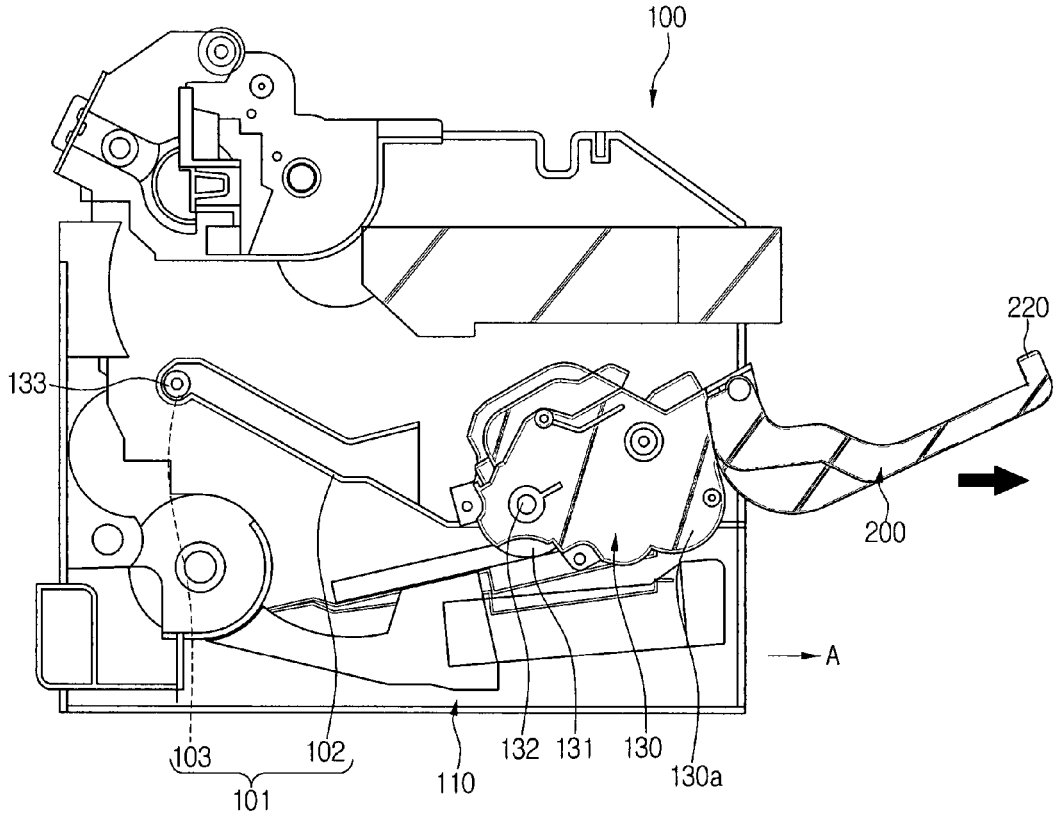
FIG. 3 illustrates removal of the developing unit including the foldable handle from the image forming apparatus.

As shown in FIGS. 2 and 3, an image forming apparatus includes a body frame 100, a paper feeding unit 110, a transfer unit 120, a developing unit 130, and a fixing unit 140. In the body frame 100, an auxiliary paper feeding unit 111 is installed between the developing unit 130 and the paper feeding unit 110 to feed sheets of paper having various sizes. The structures and functions of the body frame 100, the paper feeding unit 110, the transfer unit 120, the developing unit 130, and the fixing unit 140 are substantially the same as those of the components of the general image forming apparatus and thus a detailed description of these components is omitted for clarity and conciseness. Hereinafter, the developing unit 130 and a handle 200 foldably installed on the developing unit 130 will be described.

The developing unit 130 is attachable to or detachable from the body frame 100. Thus the developing unit 130 may be detached from the body frame 100 in instances such as when a developer is exhausted or a sheet of paper is jammed. The developing unit 130 includes a photosensitive body 131, a case 130*a* to protect an image forming unit. Moreover, a developing roller (not shown) is provided to supply a powdered developer to the photosensitive body 131 and the handle 200 is installed on the case 130*a*.

The case 130*a* pivotably supports the photosensitive body 131 on which an electrostatic latent image is formed by light irradiated from an exposing unit 105. The developing unit 130 develops the powdered developer on the photosensitive body 131 and is preferably formed of an outer case or frame of the developing unit 130. A pivot shaft 132 preferably protrudes to the outside of the case 130*a* to power the photosensitive body 131. The pivot shaft 132 guides the developing unit 130 toward a developing unit mounting unit 101 installed on the body frame 100.

As shown in FIGS. 2 and 3, the developing unit mounting unit 101 is positioned substantially lower than the fixing unit 140 so as to position the developing unit 130 under the fixing unit 140. The developing unit mounting unit 101 includes a guide rail 102 and a shaft supporter 103.

The guide rail 102 supports both ends of the pivot shaft 132 and guides the developing unit 130 to a mounting position thereof. The guide rail 102 preferably slants from the mounting position as shown in FIGS. 2 and 3.

The shaft supporter 103 is substantially concave as shown in FIGS. 2 and 3. Thus, both ends of the pivot shaft 132 are put on the shaft supporter 103. Additionally, a power transmitting unit 133 (shown in FIG. 3) and may be installed on the shaft supporter 103.

The developing unit 130 may be removed from the image forming apparatus in a direction indicated by arrow A as shown in FIG. 3. This direction is the same direction along which the paper feeding unit 110 is removed.

Figure 5:
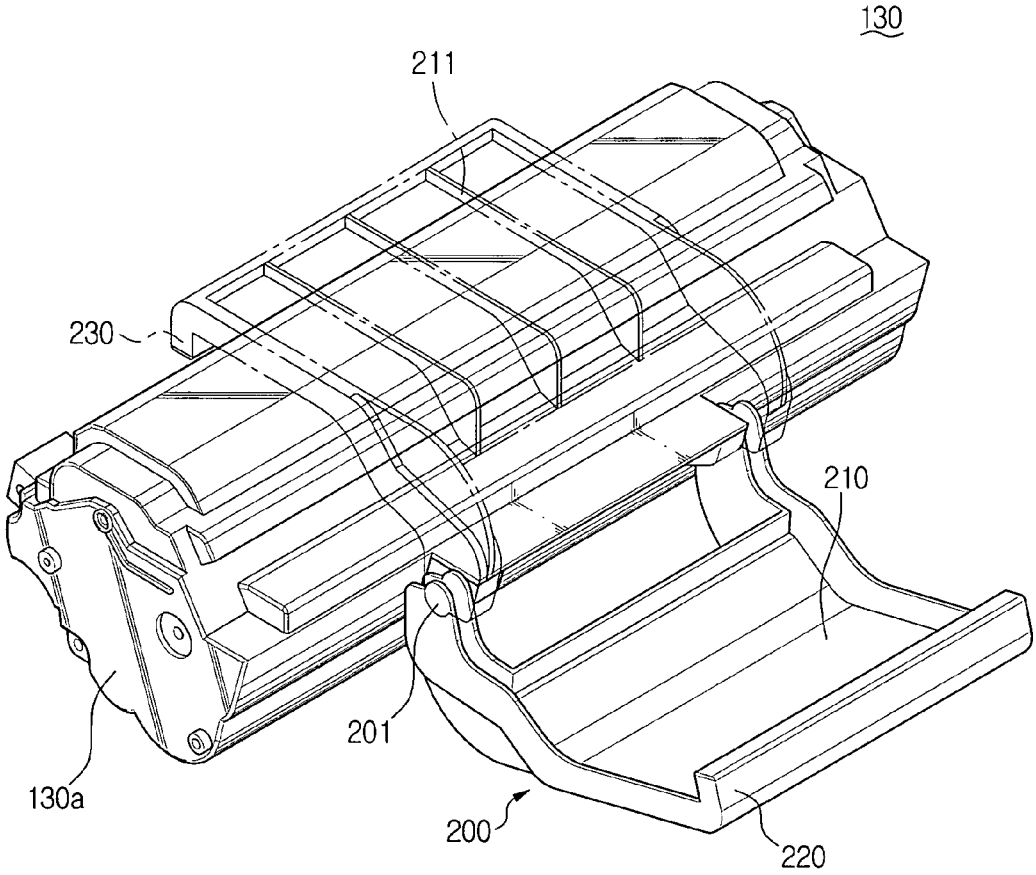
FIG. 5 is a perspective view of the developing unit shown in FIG. 4.

The handle 200 preferably has a smaller width than that of the case 130*a*. The handle 200 is foldably combined with an approximate center of the case 130*a* by a hinge 201. Thus, the handle 200 may pivot on the hinge 201 from its storage position 230 attached to the case 130*a* to a use position to which the handle 200 pivots about 180° from the storage position 230 as shown in FIG. 5. The handle 200 includes a guide plate 210 and a gripping unit 220.

As shown in FIG. 5, a plurality of guide ribs 211 are formed on the back surface of the guide plate 210. The guide ribs 211 guide a transport path of a sheet of paper P fed from the auxiliary paper feeding unit 111.

The gripping unit 220 is preferably bent from an end of the guide plate 210 and so that the gripping unit may be conveniently pulled by a user.

The operation of the image forming apparatus including the developing unit 130 and the foldable handle 200 will now be described.

As shown in FIG. 2, the developing unit 130 is mounted on the body frame 100 with the handle 200 unfolded. If a sheet of paper is jammed or a developer is exhausted, the developing unit 130 is removed from the body frame 100 as shown in FIG. 3. In other words, if the user grips and pulls the gripping unit 220 of the handle 200 in the direction indicated by a thick arrow shown in FIG. 3, the pivot shaft 132 is released from the shaft supporter 103 and is removed along the guide rail 102 toward a front portion of the body frame 100. That is, in an identical direction to a direction along which the paper feeding unit 110 is removed. Since the handle 200 is installed in the vicinity of the approximate center of the case 130*a*, a force by which the user pulls the handle 200 is directed towards the center of the developing unit 130 so that the user may remove the developing unit 130 with relatively little effort.

Figure 4:
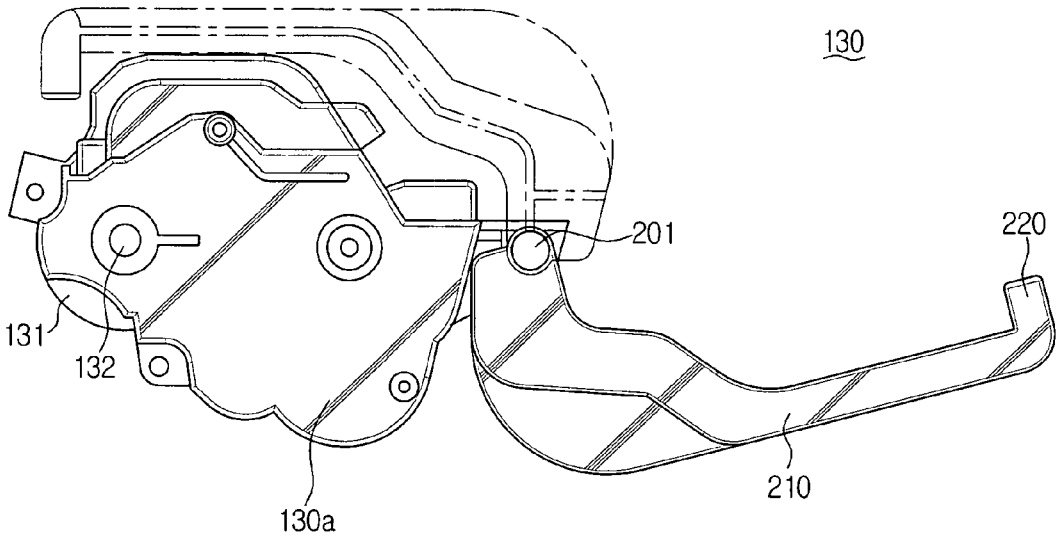
FIG. 4 illustrates an example of folding the foldable handle of the developing unit shown in FIG. 3.

As shown in FIGS. 4 and 5, in the developing unit 130 that has been removed, the handle 200 pivots on the hinge 201 so as to be folded toward the storage position 230 attached to the case 130*a*. When the handle 200 is folded toward the storage position 230, the package size of the developing unit 130 may be reduced. In this case, the handle 200 encloses an outer surface of the developing unit 130 and relieves a sudden external impact on the developing unit 130. As a result, the durability of the developing unit 130 may be improved.

The developing unit 130 is mounted on the body frame 100 in a reverse order to the above-described removal order. In other words, the user unfolds the handle 200 toward the use position and pushes the gripping unit 220 so as to position the developing unit 130 to the developing unit mounting unit 101. As described above, when the handle 200 is unfolded toward the use position, the plurality of guide ribs 211 formed on the back surface of the guide plate 210 may guide the transport path of the sheet of paper P fed from the auxiliary paper feeding unit 111.

As described above, in an image forming apparatus provided with a developing unit having a handle in accordance with aspects of the present invention, the handle can be foldably installed on the developing unit. Thus, when the developing unit is packaged, the size of the developing unit may be reduced. Also, an external impact on the developing unit may also be relieved. As a result, the durability of the developing unit may be improved.

In addition, the handle may be used to mount and remove the developing unit. Moreover, when the handle is installed on the developing unit, the handle may also be unfolded and used as a paper guide. Accordingly, the utility value of the handle is improved.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developing unit of an image forming apparatus, comprising:

an image forming unit including at least one of a photosensitive body and a developing roller for developing a developer on the photosensitive body;

a case to protect the image forming unit;

a handle installed on the case to handle the developing unit; and a hinge connecting the case and the handle;

wherein the handle is rotated by the hinge which pivots, in close proximity to the case, between a first position which is a folding position to protect the case from external impact and a second position which is opposite to the first position and an unfolding position in the same direction as a direction in which the developing unit is inserted into and ejected from the image forming apparatus;

wherein the handle serves as a paper guide; and wherein the hinge is installed in an approximate center of the case when viewed from a side direction.

2. A developing unit which is removably installed in an image forming apparatus in a horizontal direction, the developing unit comprising:

an image forming unit comprising at least one photosensitive body and a developing roller to develop a developer onto the photosensitive body;

a case in which the image forming unit is installed at a leading edge with respect to a mounting direction; and a handle is connected to a trail edge opposite the leading edge of the case and includes a grip portion which a user holds, wherein the handle remains unfolded during and after installation of the case in the image forming apparatus.

3. The developing unit according to claim 2, wherein when the case is not inserted into the image forming apparatus, the handle is folded so that the grip portion may cover the leading edge in which the image forming unit is installed.

4. The developing unit according to claim 3, wherein a length of the unfolded handle is longer than a length of the case with respect to the mounting direction of the case.

5. The developing unit according to claim 4, wherein the handle has a substantially smaller width than a width of the case and is installed in an approximate center of the case to be folded by a hinge.

6. The developing unit according to claim 2, wherein the handle is connected by a hinge.

7. The developing unit according to claim 6, wherein the handle comprises two connecting portions connected with the hinge.

8. The developing unit according to claim 7, wherein the handle is rotated by the hinge which pivots between a first position which is a folding position to protect the case from external impact and a second position which is opposite to the first position and an unfolding position in the same direction as a direction in which the developing unit is inserted into or ejected from the image forming apparatus.

9. The developing unit according to claim 8, wherein the first position is a delivery position in which the developing unit is not installed in the image forming apparatus, and the second position is a use position in which the developing unit is installed in the image forming apparatus.

10. The developing unit according to claim 6, wherein the case moves with respect to the hinge so as to be inserted into or ejected from the image forming apparatus.

* * * * *